US010415398B2

(12) United States Patent
Miyoshi

(10) Patent No.: US 10,415,398 B2
(45) Date of Patent: Sep. 17, 2019

(54) TURBINE BLADES AND GAS TURBINE HAVING THE SAME

(71) Applicant: Mitsubishi Hitachi Power Systems, Ltd., Nishi-ku, Yokohama (JP)

(72) Inventor: Ichiro Miyoshi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 0 days.

(21) Appl. No.: 15/883,564

(22) Filed: Jan. 30, 2018

(65) Prior Publication Data

US 2018/0266255 A1 Sep. 20, 2018

(30) Foreign Application Priority Data

Mar. 15, 2017 (JP) ..... 2017-049392

(51) Int. Cl.
*F01D 5/18* (2006.01)
*F01D 5/14* (2006.01)

(52) U.S. Cl.
CPC ..... *F01D 5/187* (2013.01); *F01D 5/145* (2013.01); *F01D 5/186* (2013.01);
(Continued)

(58) Field of Classification Search
CPC ..... F01D 5/187; F01D 5/145; F05D 5/186; F05D 2220/32; F05D 2260/202; F05D 2260/2212; F05D 2270/17
(Continued)

(56) References Cited

U.S. PATENT DOCUMENTS 2,489,683 A * 11/1949 Stalker ..... F01D 5/08 415/115
5,383,766 A 1/1995 Przirembel et al.
(Continued)

FOREIGN PATENT DOCUMENTS

EP 2 584 148 A1 4/2013
EP 2 993 304 A1 3/2016
(Continued)

OTHER PUBLICATIONS

Russian-language Office Action issued in counterpart Russian Application No. 2018103176 dated Oct. 23, 2018 with English translation (11 pages).
(Continued)

*Primary Examiner* — Nathaniel E Wiehe
*Assistant Examiner* — David Whittaker
(74) *Attorney, Agent, or Firm* — Crowell & Moring LLP

(57) ABSTRACT

A turbine blade according to the invention includes a first wall surface facing a cooling passage through which cooling air flows; a second wall surface facing a working fluid passage through which a working fluid flows; a communication hole establishing communication between the cooling passage and the working fluid passage; and a projection provided on the downstream side of the flowing direction of the cooling air in the opening of the communication hole formed in the first wall surface, the projection protruding from the first wall surface toward the cooling passage. The projection includes a slope section formed on the first wall surface that ascends in the direction opposite the flowing direction of the cooling air toward the cooling passage and a curved section formed as a convex section on the side of the cooling passage, the curved section extending along the opening in the form of an arc.

4 Claims, 7 Drawing Sheets

(52) U.S. Cl.
CPC .... *F05D 2220/32* (2013.01); *F05D 2260/202* (2013.01); *F05D 2260/2212* (2013.01); *F05D 2270/17* (2013.01)

(58) Field of Classification Search
USPC ..... 416/97
See application file for complete search history.

(56) References Cited

U.S. PATENT DOCUMENTS

| | | | | |
|---|---|---|---|---|
| 5,941,686 | A | 8/1999 | Gupta et al. | |
| 8,807,943 | B1 * | 8/2014 | Liang | F01D 5/187 415/115 |
| 2006/0226290 | A1 | 10/2006 | Campbell | |
| 2008/0203236 | A1 | 8/2008 | Mazzola et al. | |
| 2010/0239412 | A1 | 9/2010 | Draper | |
| 2016/0061451 | A1 | 3/2016 | Dudebout et al. | |

FOREIGN PATENT DOCUMENTS

| | | | |
|---|---|---|---|
| EP | 3 012 407 | A1 | 4/2016 |
| EP | 3 205 822 | A1 | 8/2017 |
| GB | 2 262 314 | A | 6/1993 |
| JP | 2010-216471 | A | 9/2010 |

OTHER PUBLICATIONS

Extended European Search Report issued in counterpart European Application No. 18154029.5 dated Jun. 7, 2018 (seven (7) pages).

* cited by examiner

TURBINE BLADES AND GAS TURBINE HAVING THE SAME

BACKGROUND OF THE INVENTION

1. Field of the Invention

The present invention relates to turbine blades and a gas turbine having the same.

2. Description of the Related Art

The turbine blades of a gas turbine are exposed to high-temperature combustion gas. For this reason, the turbine blades need to be cooled to prevent the high-temperature oxidation of or thinning-induced damage to the turbine blades due to the high-temperature combustion gas. One method of cooling a turbine blade is to form film cooling holes on the surface of the blade through which the cooling air flowing in the internal cooling passage of the blade flows out. After flowing out from the film cooling holes, the cooling air flows along the blade surface and forms a cooling film, thereby preventing the entry of the heat of high-temperature combustion gas into the turbine blade.

The cooling air flowing out of the film cooling holes is mixed with combustion gas, which typically involves mixing loss. This in turn results in reduced heat efficiency of the turbine. For this reason, attempts have been made to improve the outlet-side airfoil at which the pressures of the film cooling holes are low, for the purposes of improving cooling efficiency and reducing the flow rate of the cooling air. By improving cooling efficiency, the amount of cooling air required for cooling the turbine blade can be reduced, which in turn improves the heat efficiency of the turbine.

On the inlet side (cooling passage side) where the pressures of the film cooling holes are high, separation areas could be formed along the flow passages due to uneven flows from cooling air plenums. The presence of the separation areas on the inlet side of the film cooling holes makes the flows of the cooling air uneven, which results in the cooling air in the film cooling holes being distorted. As a result, the directions of the flows of the cooling air flowing out of the film cooling holes are changed, making it difficult for the cooling air to flow along the blade surface. This in turn reduces the cooling efficiency of the turbine blade. To overcome such problems, some turbine blades are designed to prevent decreases in their cooling efficiency by providing tapered sections at the inlet side of the film cooling holes and promoting the entry of the cooling air into the film cooling holes (see JP-2010-216471-A).

SUMMARY OF THE INVENTION

In recent years, to improve the efficiency of a gas turbine, the temperature of combustion gas tends to be increased. Thus, it is desired to cool every part of the turbine blades to further improve the cooling efficiency of the turbine blades. However, in JP-2010-216471-A, because the tapered sections are provided at the extended inlets of the film cooling holes, difficulties are involved in providing them at positions where the turbine blade thickness is small, due to the necessity to ensure the strength of the turbine blade. In such a case, it is difficult to improve the cooling efficiency of the turbine blade more than that.

The present invention has been made in view of the above problems, and an object of the invention is to further improve the cooling efficiency of turbine blades.

To achieve the above object, a turbine blade according to the invention includes: a first wall surface facing a cooling passage through which cooling air flows; a second wall surface facing a working fluid passage through which a working fluid flows; a communication hole establishing communication between the cooling passage and the working fluid passage; and a projection provided on a downstream side of the flowing direction of the cooling air in an opening of the communication hole, the opening being formed in the first wall surface, the projection protruding from the first wall surface toward the cooling passage.

The invention allows for further improvement in the cooling performance of turbine blades.

DESCRIPTION OF THE PREFERRED EMBODIMENT (Structure)

1. Gas Turbine

Figure 1:
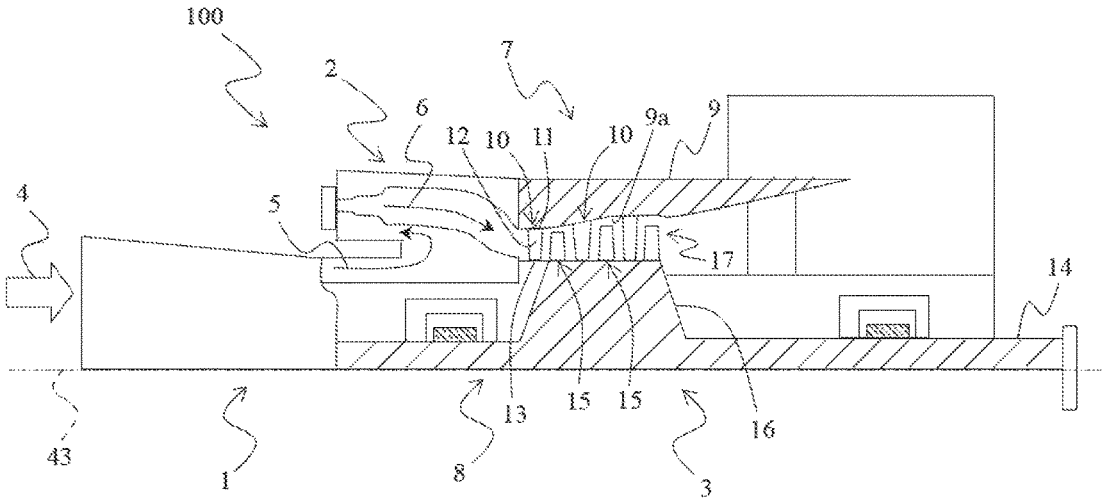
FIG. 1 illustrates an example of a gas turbine to which are applied turbine blades according to an embodiment of the invention.

FIG. 1 illustrates an example of a gas turbine to which are applied turbine blades according to an embodiment of the invention.

As illustrated in FIG. 1, the gas turbine 100 includes a compressor 1, a combustor 2, and a turbine 3.

The compressor 1 compresses the air 4 drawn in via an intake section (not illustrated) to generate high-pressure compressed air (air used for combustion) 5 and supplies it to the combustor 2. The combustor 2 mixes the compressed air 5 supplied from the compressor 1 with the fuel supplied from a fuel supply system (not illustrated) and combusts the mixed gas. The resultant combustion gas (working fluid) 6 is supplied to the turbine 3. The turbine rotor 8 (described later in detail) of the turbine 3 is rotated by the expansion of the combustion gas 6 supplied from the combustor 2. In the present embodiment, the turbine rotor 8 is connected to the rotor of the compressor 1 (not illustrated), whereby the rotational power obtained in the turbine 3 is used to drive the compressor 1. In the present embodiment, a generator or a load (not illustrated) is also connected to the turbine rotor 8, whereby the power remaining after subtracting the power needed to drive the compressor 1 from the rotational power obtained in the turbine 3 is converted into electric power by the generator. The combustion gas 6 that has driven the turbine rotor 8 is eventually discharged into the atmosphere as turbine exhaust.

2. Turbine

The turbine 3 includes a stator 7 and the turbine rotor 8 that rotates relative to the stator 7.

The stator 7 includes a casing 9 and stator vanes (turbine blades) 10.

The casing 9 is a cylindrical member forming the outer wall of the turbine 3. Housed within the casing 9 are the stator vanes 10 and the turbine rotor 8.

The stator vanes 10 are provided on the circumferentially inner wall 9*a* of the casing 9 along a circumferential direction of the turbine rotor 8. The stator vanes 10 each includes a circumferentially outer endwall section (stator vane circumferentially outer endwall section) 11, a blade section (stator vane blade section) 12, and a circumferentially inner endwall section (stator vane circumferentially inner endwall section) 13. The circumferentially outer endwall section 11 is a cylindrical member extending in a circumferential direction of the turbine rotor 8 and is supported by the circumferentially inner wall 9*a* of the casing 9. The blade section 12 extends from the circumferentially inner surface of the circumferentially outer endwall section 11 toward the radially inner side of the turbine rotor 8. In the present embodiment, the blade section 12 has an internal cooling passage (not illustrated). Note that hereinafter the radially inner and outer sides of the turbine rotor 8 are referred to simply as "the radially inner side" and "the radially outer side." The circumferentially inner endwall section 13 is also a cylindrical member extending in a circumferential direction of the turbine rotor 8 and is provided on the radially inner side of the circumferentially outer endwall section 11. The blade section 12 is connected to the circumferentially outer surface of the circumferentially inner endwall section 13. In other words, the blade section 12 is fixed between the circumferentially outer endwall section 11 and the circumferentially inner endwall section 13.

The turbine rotor 8 includes a turbine shaft section 14 and rotor blades (turbine blades) 15.

The turbine shaft section 14 extends along the rotary shaft (central axis) 43 of the turbine 3 and includes a turbine disk 16. The turbine disk 16 extends from the circumferentially outer surface of the turbine shaft section 14 toward the radially outer side. The turbine disk 16 includes an inner hollow section 22 (described later).

The rotor blades 15 are provided on the circumferentially outer surface of the turbine disk 16 along a circumferential direction of the turbine rotor 8. Together with the turbine shaft section 14, the rotor blades 15 rotate relative to the rotary shaft 43 by the combustion gas 6 flowing through a combustion gas passage (working fluid passage) 17. The stator vanes 10 and the rotor blades 15 are provided alternately in the flowing direction of the combustion gas 6. That is, from the entrance of the combustion gas passage 17 to the downstream side of the flowing direction of the combustion gas 6, a stator vane 10 is first provided, followed by a rotor blade 15, then by another stator vane 10 and another rotor blade 15, and so forth. A pair of a stator vane 10 and a rotor blade 15 that are adjacent to each other in the direction from the entrance of the combustion gas passage 17 to the downstream side of the flowing direction of the combustion gas 6 constitutes a blade stage. Note that hereinafter the upstream and downstream sides of the flowing direction of the combustion gas 6 are referred to simply as "the combustion upstream side" and "the combustion downstream side."

3. Rotor Blades

Figure 2:
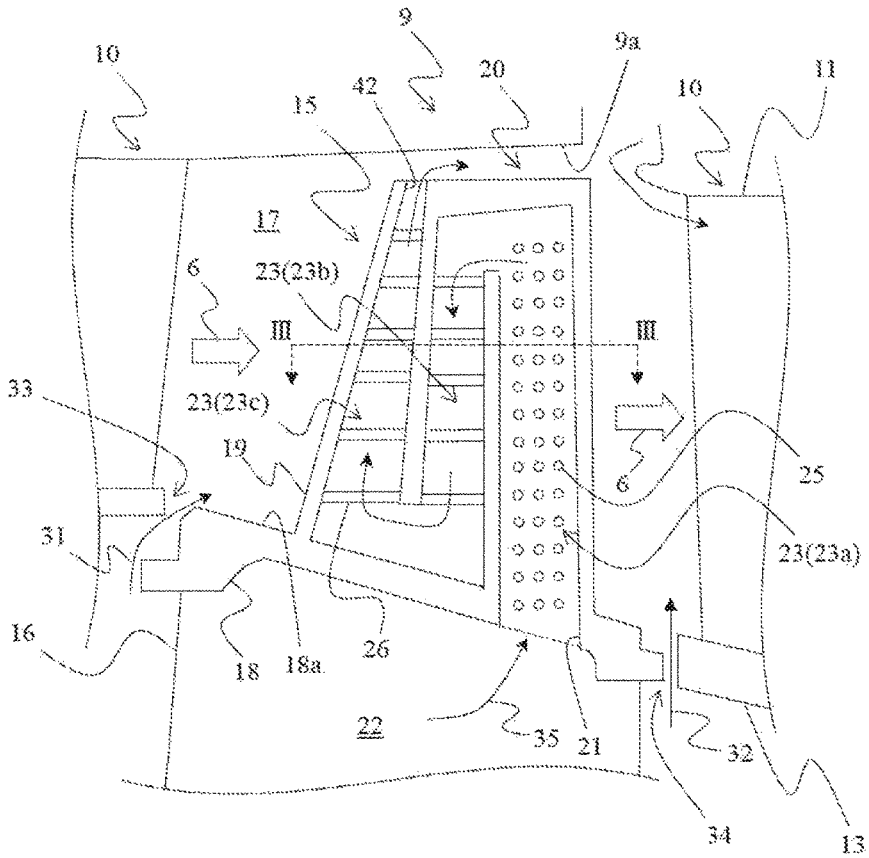
FIG. 2 is a cross section illustrating the internal structure of a rotor blade according to an embodiment of the invention.

FIG. 2 is a cross section illustrating the internal structure of a rotor blade according to the present embodiment.

As illustrated in FIG. 2, the rotor blade 15 includes a circumferentially inner endwall section (rotor blade circumferentially inner endwall section) 18 and a blade section (rotor-blade blade section) 19.

The circumferentially inner endwall section 18 is provided on the turbine disk 16 such that it faces the circumferentially inner wall 9*a* of the casing 9 with the combustion gas passage 17 placed therebetween. The combustion gas passage 17 is the annular space surrounded by the circumferentially outer surface of the circumferentially inner endwall section 13, the circumferentially outer surface 18*a* of the circumferentially inner endwall section 18, the circumferentially inner wall 9*a* of the casing 9, and the circumferentially inner surface of the circumferentially outer endwall section 11. In other words, the circumferentially inner walls of the combustion gas passage 17 are formed by the circumferentially outer surface of the circumferentially inner endwall section 13 and the circumferentially outer surface 18*a* of the circumferentially inner endwall section 18 while the circumferentially outer walls of the combustion gas passage 17 are formed by the circumferentially inner wall 9*a* of the casing 9 and the circumferentially inner surface of the circumferentially outer endwall section 11.

The blade section 19 extends from the circumferentially outer surface 18*a* of the circumferentially inner endwall section 18 toward the radially outer side. A space 20 is formed between the circumferentially outer section (radially outer side end) of the blade section 19 and the circumferentially inner wall 9*a* of the casing 9.

The blade section 19 includes an internal cooling passage 23. The cooling passage 23 communicates with the inner hollow section 22 of the turbine disk 16 via an opening (cooling air inlet) 21. The blade section 19 is cooled from within by the cooling air flowing through the cooling passage 23. In the present embodiment, the cooling passage 23 includes a first cooling passage 23*a*, a second cooling passage 23*b*, and a third cooling passage 23*c*. The first cooling passage 23*a* is the section located on the combustion downstream side of the cooling passage 23 and extends from the opening 21 toward the radially outer side. Multiple pin fins 25 are provided in the first cooling passage 23*a* to disturb the flow of the cooling air flowing through the first cooling passage 23*a*. The second cooling passage 23*b* is the section located on the combustion upstream side of the first cooling passage 23*a* in the cooling passage 23. The second cooling passage 23*b* communicates with the other side (radially outer side) end of the first cooling passage 23*a* and extends therefrom toward the radially inner side. The third cooling passage 23*c* is the section located on the combustion upstream side of the second cooling passage 23*b* in the cooling passage 23. The third cooling passage 23*c* communicates with the one end (radially inner end) of the second cooling passage 23*b* and extends therefrom toward the radially outer side. Multiple fins 26 are provided in the second cooling passage 23*b* and the third cooling passage 23*c*. The fins 26 are used to promote heat exchange between the cooling air flowing through the second and third cooling passages 23*b* and 23*c* and the blade section 19. The other end (radially outer end) of the third cooling passage 23*c* communicates with the combustion gas passage 17 via an opening (cooling air outlet) 42. As stated above, in the present embodiment, the cooling passage 23 includes the first, second, and third cooling passages 23*a*, 23*b*, and 23*c*, and the blade section 19 is cooled by convection cooling. However, it is also possible to cool the blade section 19 using a different method.

Figure 3:
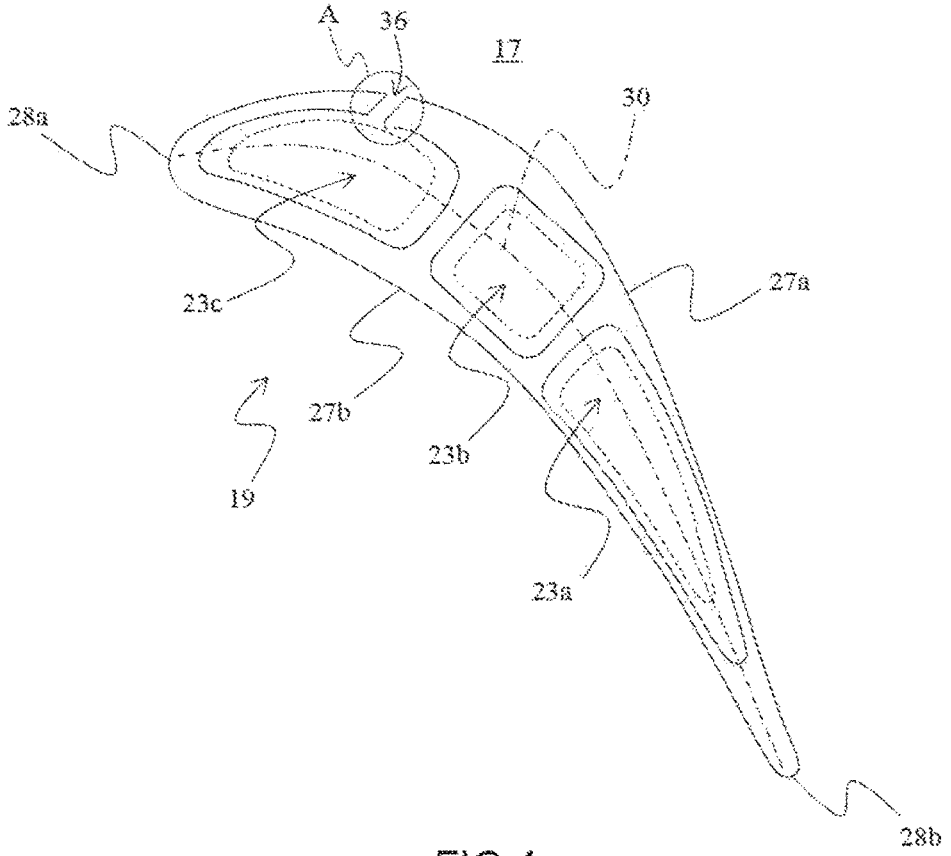
FIG. 3 is a cross section taken along arrow III-III of FIG. 2 and viewed from the direction of the arrow.

FIG. 3 is a cross section taken along arrow III-III of FIG. 2 and viewed from the direction of the arrow. The cross section of the blade section 19 illustrated in FIG. 3 is hereinafter referred to also as the blade cross section.

As illustrate in FIG. 3, the blade section 19 includes a positive pressure surface (pressure surface) 27*b* located on the front side of the blade, a negative pressure surface 27*a* located across from the positive pressure surface 27*b* or on the back side of the blade, a blade leading edge 28*a*, and a blade trailing edge 28*b*. If a collection of points that are each equidistant from the positive pressure surface 27*b* and the negative pressure surface 27*a* and that are collected from the blade leading edge 28*a* to the blade trailing edge 28*b* is defined as the blade center line 30, the positive pressure surface 27*b* is convex-shaped relative to the blade center line 30 while the negative pressure surface 27*a* is concave-shaped relative to the blade center line 30. The blade section 19 is formed such that its thickness (the distance between the positive pressure surface 27*b* and the negative pressure surface 27*a* in a direction perpendicular to the blade center line 30) becomes gradually large as viewed from the blade leading edge 28*a* to the middle of the blade section 19 and becomes gradually small as viewed from the middle of the blade section 19 to the blade trailing edge 28*b*.

Figure 4:
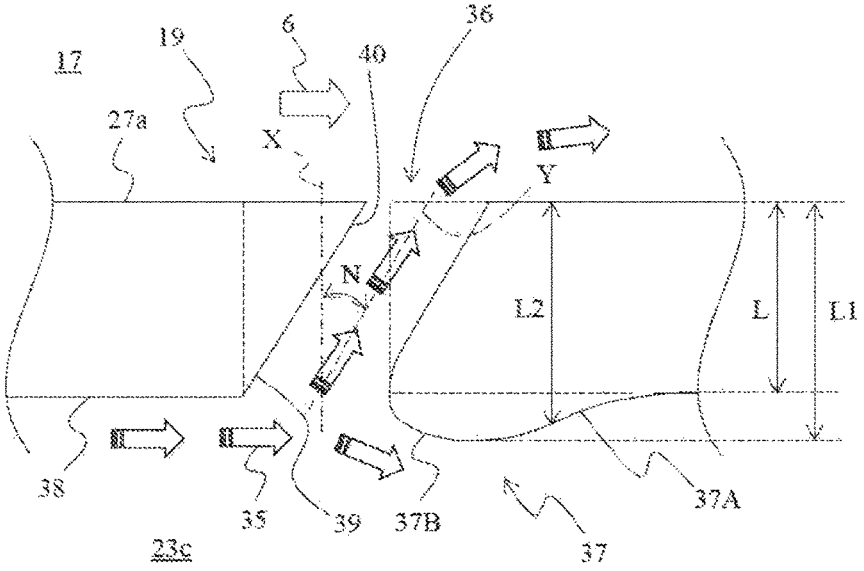
FIG. 4 is an enlarged view of the dotted area A of FIG. 3.

FIG. 4 is an enlarged view of the dotted area A of FIG. 3.

As illustrated in FIG. 4, the blade section 19 includes film cooling holes (communication holes) 36 and a projection 37.

The communication holes 36 establish communication between the third cooling passage 23*c* and the combustion gas passage 17. Each of the communication holes 36 includes an opening (first opening) 39 provided on a wall surface (first wall surface) 38 that faces the third cooling passage 23*c* and constitutes the circumferentially outer surface of the third cooling passage 23*c* and an opening (second opening) 40 provided on the negative pressure surface (second wall surface) 27*a* that faces the combustion gas passage 17 of the blade section 19. The first opening 39 is the inlet into which the cooling air (rotor blade cooling air) 35 flowing through the third cooling passage 23*c* flows while the second opening 40 is the outlet from which the cooling air 35 flows out via the communication hole 36. In the present embodiment, the communication holes 36 are provided in a longitudinal direction of the blade section 19 (in a direction perpendicular to the drawing plane of FIG. 4).

Each of the communication holes 36 is formed such that the second opening 40 is displaced relative to the first opening 39 toward the combustion downstream side. If the second opening 40 and the first opening 39 are assumed to coincide with each other in the flowing direction of the combustion gas, connecting the centers of the first and second openings results in the reference central axis X of the communication hole being obtained. In the present embodiment, the actual central axis Y of the communication hole 36 obtained by connecting the centers of the first and second openings is slanted relative to the reference central axis X toward the combustion downstream side. Thus, in the present embodiment, the first and second openings 39 and 40 of the communication hole 36 are ellipse-shaped. The tilt angle N of the communication hole 36 (the angle between the reference central axis X and the actual central axis Y) is set such that the cooling air 35 discharged toward the combustion gas passage 17 through the communication hole 36 flows as close to the outer surfaces of the blade section 19 as possible.

The projection 37 is provided on the downstream side of the flowing direction of the cooling air 35 in the first opening 39 of the communication hole 36 (in FIG. 4, on the combustion downstream side of the first opening 39 of the communication hole 36). Hereinafter, the upstream and downstream sides of the flowing direction of the cooling air 35 are referred to also as "the cooling upstream side" and "the cooling downstream side." The projection 37 protrudes from the first wall surface 38 toward the third cooling passage 23*c*. The length L1 from the negative pressure surface 27*a* of the blade section 19 measured at the farthest position of the projection 37 from the first wall surface 38 (also referred to as "the apex") is larger than the length L between the negative pressure surface 27*a* of the blade section 19 and the first wall surface 38. As a result, the passage area of the section of the third cooling passage 23*c* where the projection 37 is provided is smaller than that of the other section where the projection 37 is not provided. In other words, the third cooling passage 23*c* is made narrower where the projection 37 is provided. The projection 37 includes a slope section 37A and a curved section 37B.

The slope section 37A is a slope ascending from the first wall surface 38 in the direction opposite the flowing direction of the cooling air 35 (toward the cooling upstream side); thus, it ascends toward the third cooling passage 23*c*. As a result, the length L2 from the negative pressure surface 27*a* of the blade section 19 to the slope section 37A gets larger as it advances against the flowing direction of the cooling air 35. The slope section 37A forms a smooth surface that lies between the curved section 37B and the first wall surface 38.

The curved section 37B forms a convex-shaped surface protruding toward the third cooling passage 23*c*; in other words, it forms an arc-shaped surface that lies between the slope section 37A and the first opening 39 of the communication hole 36. The curvature of the curved section 37B is determined to achieve such a smooth arc-shaped surface.

Figure 5:
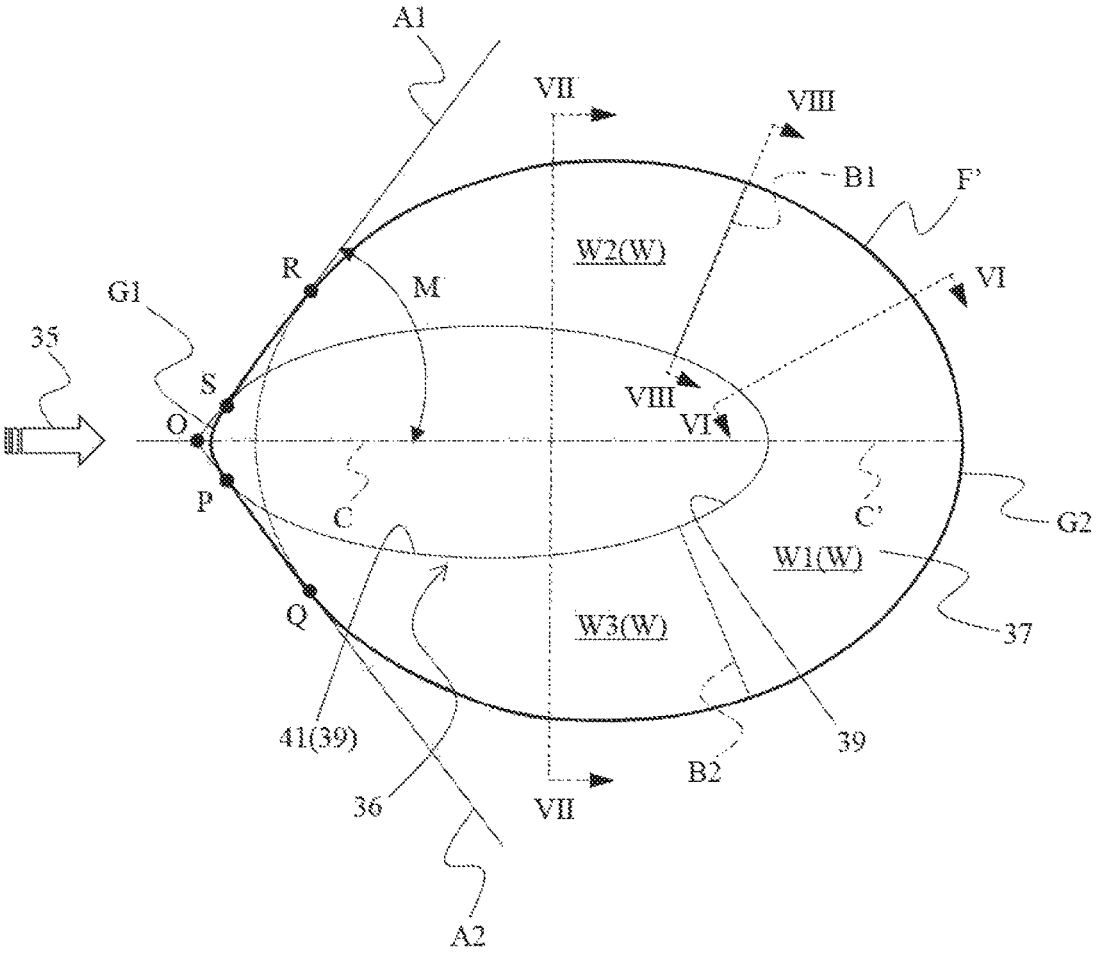
FIG. 5 is an enlarged view of a communication hole as viewed from a third cooling passage.
Figure 6:
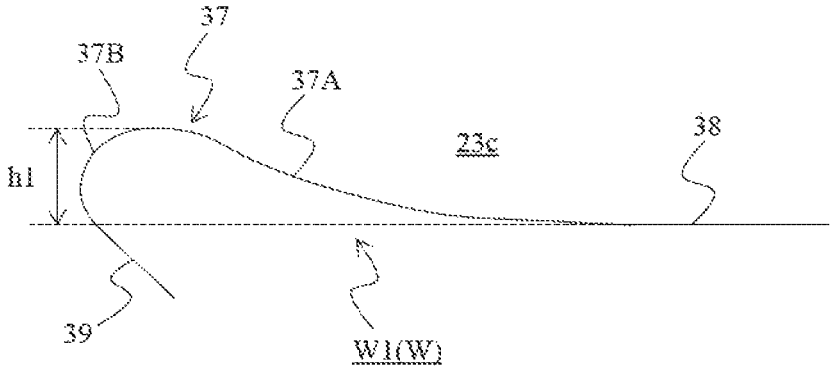
FIG. 6 is a cross section taken along arrow VI-VI of FIG. 5 and viewed from the direction of the arrow.
Figure 7:
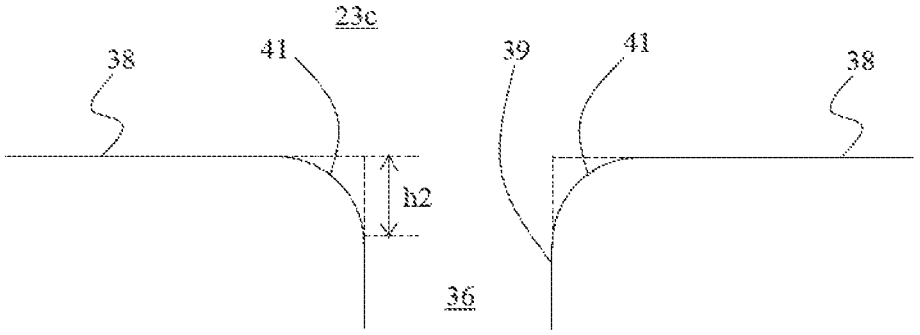
FIG. 7 is a cross section taken along arrow VII-VII of FIG. 5 and viewed from the direction of the arrow.
Figure 8:
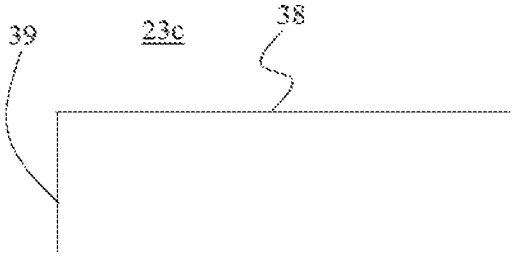
FIG. 8 is a cross section taken along arrow VIII-VIII of FIG. 5 and viewed from the direction of the arrow.

FIG. 5 is an enlarged view of the communication hole 36 as viewed from the third cooling passage 23*c*. FIG. 6 is a cross section taken along arrow VI-VI of FIG. 5 and viewed from the direction of the arrow. FIG. 7 is a cross section taken along arrow VII-VII of FIG. 5 and viewed from the direction of the arrow. FIG. 8 is a cross section taken along arrow VIII-VIII of FIG. 5 and viewed from the direction of the arrow.

As illustrated in FIGS. 5 and 6, in the present embodiment, the projection 37 is provided in the area W1 of the area W (described later in detail). The area W is formed between the edge of the first opening 39 and the ellipse F' surrounding the first opening 39, and the area W1 is the section of the area W enclosed by the two boundaries B1 and B2.

As illustrated in FIGS. 5 and 7, in the present embodiment, a curved section (second curved section) 41 is formed at the edge of the first opening 39 of the communication hole 36. The second curved section 41 forms a smooth curved surface from the first wall surface 38 to the first opening 39; in other words, it forms a convex-shaped surface facing the third cooling passage 23*c*. The second curved section 41 is provided adjacent to the projection 37 in a circumferential direction of the first opening 39. Specifically, the second curved section 41 is provided in the areas W2 and W3 that are adjacent to the area W1 of the area W in a circumferential direction of the first opening 39.

As illustrated in FIG. 8, in the present embodiment, the projection 37 and the second curved section 41 are in contact with the first wall surface 38 on the same plane. If the length of the projection 37 from the first wall surface 38 to the apex of the projection 37 is defined as the height h1 (see FIG. 6) and the length of the second curved section 41 from the first wall surface 38 to the edge of the second curved section 41 on the side of the first opening 39 is defined as the height h2 (see FIG. 7), the height h1 of the projection 37 is smaller at sections closer to the second curved section 41 while the height h2 of the second curved section 41 is smaller at sections closer to the projection 37 in the circumferential direction of the first opening 39.

Figure 9:
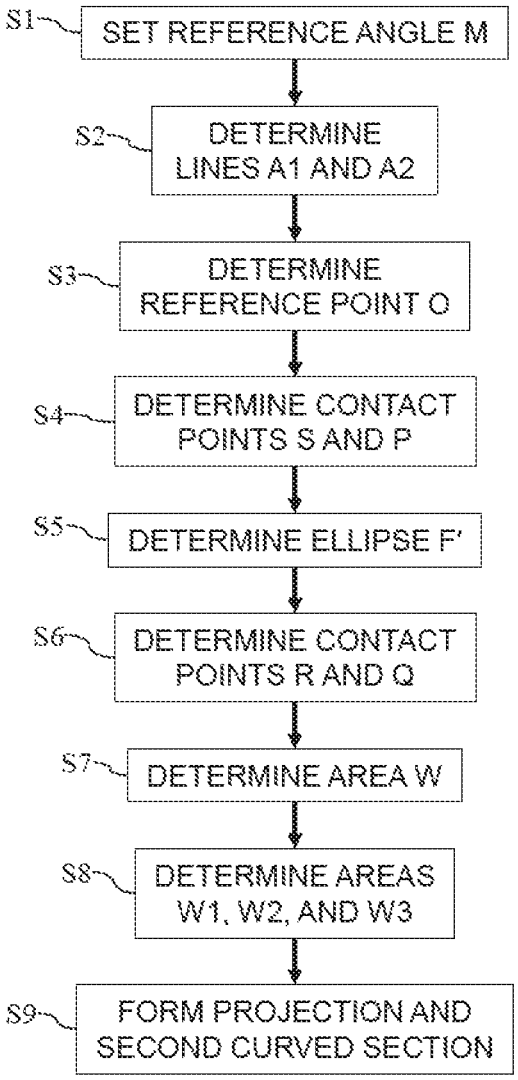
FIG. 9 is a flowchart illustrating the procedures for forming a projection and a second curved section.

FIG. 9 is a flowchart illustrating the procedures for forming the projection 37 and the second curved section 41. The procedures for forming the projection 37 and the second curved section 41 are described below with reference to FIGS. 5 and 9.

Step S1

A reference angle M is determined based on the oscillatory width of the cooling air 35 flowing through the communication hole 36. The oscillatory width of the cooling air 35 is an index indicating the degrees of deviation of the flowing direction of the cooling air 35 relative to the central axis of the communication hole 36. The reference angle M is a circumferential angle relative to the longitudinal axis of the first opening 39 of the communication hole 36 when the communication hole 36 is viewed from the side of the third cooling passage 23*c*, and as stated above, the reference angle M is determined based on the oscillatory width of the cooling air 35. The reference angle M is 45 degrees, for example. The longitudinal axis C of the first opening 39 of the communication hole 36 is hereinafter also called the communication hole longitudinal axis.

Step S2

The lines (tangents) A1 and A2 are determined. The lines A1 and A2 are the lines that are in contact with the edge of the first opening 39 of the communication hole 36 and have the reference angle M determined in Step S1 relative to the communication hole longitudinal axis C.

Step S3

The reference point O is determined. The reference point O is the intersecting point among the lines A1 and A2 and an extension of the communication hole longitudinal axis C that runs in the direction opposite the flowing direction of the cooling air 35.

Step S4

The contact points S and P are determined. The contact points S and P are the points at which the lines A1 and A2 are in contact with the edge of the first opening 39 of the communication hole 36.

Step S5

The ellipse F' is determined. The ellipse F' is inscribed in the lines A1 and A2, and an extension of its longitudinal axis C' passes the reference point O and matches the communication hole longitudinal axis C.

Step S6

The contact points R and Q at which the lines A1 and A2 are in contact with the ellipse F' are determined.

Step S7

The area W is determined. First, the curve G1 that starts from the contact point Q, passes the contact points P and S clockwise, and ends at the contact point R is obtained. Then, the curve G2 that starts from contact point R, passes along the ellipse F' clockwise, and ends at the contact point Q is obtained. The area W is determined by excluding the first opening 39 of the communication hole 36 from the area enclosed by the curves G1 and G2. The area W is not limited to particular sizes as long as it does not interfere with the areas W of the adjacent communication holes 36 arranged in a longitudinal direction of the blade section 19.

Step S8

The area W is divided into the first area W1, the second area W2, and the third area W3. In the present embodiment, the first area W1 is larger than the second area W2 and the third area W3, and the second area W2 and the third area W3 are equal in size.

Step S9

The projection 37 is formed in the first area W1, and the second curved section 41 is formed in the second and third areas W2 and W3. An example of the method of forming the projection 37 and the second curved section 41 is precision casting. By precision casting, the blade section 19 having the projection 37 can be formed.

(Operation)

Referring now to FIG. 2, we describe how the cooling air 35 cools the blade section 19.

In the present embodiment, part of the compressed air is extracted from an intermediate stage or the outlet of the compressor 1 (see FIG. 1) to use it as the cooling air. The compressed air extracted from the compressor 1 flows into the turbine shaft section 14 of the turbine rotor 8 as the cooling air via a hole section of the turbine shaft section 14 (not illustrated). As illustrated by the arrows 31 and 32 of FIG. 2, part of the cooling air flowing through the turbine shaft section 14 flows into the combustion gas passage 17 via the gap 33 formed between the rotor blade 15 and the adjacent stator vane 10 located on the combustion upstream side and via the gap 34 formed between the rotor blade 15 and the adjacent stator vane 10 located on the combustion downstream side and merges with the combustion gas 6. Part of the cooling air flowing through the turbine shaft section 14 also flows into the hollow section 22 of the turbine disk 16 as the cooling air 35. The cooling air 35 flowing through the hollow section 22 enters the first cooling passage 23*a* via the opening 21 while cooling the turbine disk 16 from within. The cooling air 35 that has entered the first cooling passage 23*a* flows through it toward the radially outer side (in the upper direction of FIG. 2). The cooling air 35 flowing through the first cooling passage 23*a* is directed toward the radially inner side (in the lower direction of FIG. 2) at the radially outer end of the first cooling passage 23*a* and thus flows into the second cooling passage 23*b*. The cooling air 35 that has entered the second cooling passage 23*b* flows through it toward the radially inner side. The cooling air 35 flowing through the second cooling passage 23*b* is directed toward the radially outer side at the radially inner end of the second cooling passage 23*b* and thus flows into the third cooling passage 23*c*. The cooling air 35 that has entered the third cooling passage 23*c* flows through it toward the radially outer side. The cooling air 35 flowing through the third cooling passage 23*c* flows into the combustion gas passage 17 via the opening 42, thus merging with the combustion gas 6.

Referring next to FIG. 4, we describe the behavior of the cooling air 35 that flows out from the third cooling passage 23*c* into the combustion gas passage 17 via the communication hole 36.

Among the flows of the cooling air 35 in the third cooling passage 23*c*, the cooling air 35 flowing close to the first wall surface 38 collides with the cooling-upstream-side wall surface at the curved section 37B of the projection 37 and decelerates. The cooling air 35 that has decelerated is directed toward the communication hole 36 along the surface of the curved section 37B. The cooling air 35 directed into the communication hole 36 flows through it to be discharged into the combustion gas passage 17. The cooling air 35 discharged into the combustion gas passage 17 flows along the surface of the blade section 19 to form a cooling film. Meanwhile the cooling air 35 that has flowed close to the first wall surface 38 and has not entered the communication hole 36 flows toward the cooling downstream side along the surface of the curved section 37B. As stated above, the passage area of the section of the third cooling passage 23*c* where the projection 37 is provided is smaller than that of the other section where the projection 37 is not provided. Thus, the cooling air 35 flowing toward the cooling downstream side along the surface of the curved section 37B is accelerated and flows along the surface of the slope section 37A.

Figure 10:
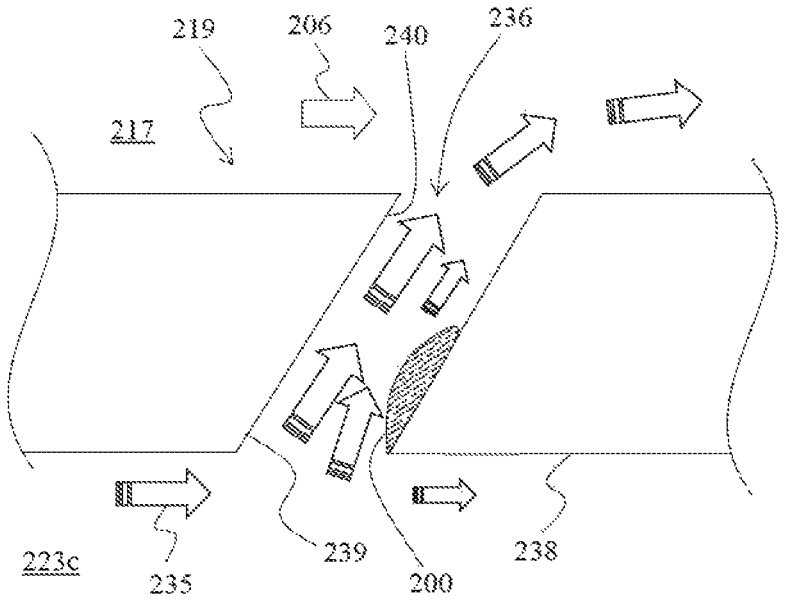
FIG. 10 is an enlarged view of a communication hole according to a comparative example.

Advantageous Effects (1) FIG. 10 is an enlarged view of a communication hole 236 according to a comparative example. As illustrated in FIG. 10, the communication hole 236 does not have a projection on the cooling downstream side of a first opening 239 that protrudes from a first wall surface 238 toward a third cooling passage 223*c*. As a result, the communication hole 236 could have a separation area 200 on the side of the first opening 239 due to uneven flows from a cooling air plenum. If the separation area 200 is formed on the side of the first opening 239 in the communication hole 236, the separation area 200 acts like an obstacle for the cooling air (rotor blade cooling air) 235 flowing through the communication hole 236; thus, the flow of the cooling air 235 within the communication hole 236 is distorted. This increases the flow speed of the cooling air 235 within the communication hole 236, making it difficult for the cooling air 235 discharged from the communication hole 236 into a combustion gas passage 217 to flow along the blade surface. As a result, cooling efficiency is reduced.

In the present embodiment, by contrast, the projection 37 is provided on the cooling downstream side of the first opening 39 of the communication hole 36 such that it protrudes from the first wall surface 38 toward the third cooling passage 23*c*, as illustrated in FIG. 4. Thus, the cooling air 35 that flows in the third cooling passage 23*c* and flows close to the first wall surface 38 is caused to collide with the wall surface of the projection 37 to decelerate it, whereby it is directed into the communication hole 36. As a result, it is possible to prevent the formation and development of a separation area in the communication hole 36, prevent the flow of the cooling air 35 in the communication hole 36 from being distorted, and prevent excessive increases in the flow speed of the cooling air 35 in the communication hole 36. Therefore, the cooling air 35 flowing out of the communication hole 36 into the combustion gas passage 17 is made to flow along the blade surface to form a cooling film, which prevents the entry of the heat of the high-temperature combustion gas into the rotor blade and improves the cooling efficiency.

(2) In the present embodiment, the projection 37 is provided on the first wall surface 38 of the blade section 19 such that it protrudes from the first wall surface 38 toward the third cooling passage 23*c*. Thus, it is possible to provide the projection 37 also at positions where the thickness of the blade section 19 is small while ensuring the strength of the turbine blade. This allows for cooling of every part of the rotor blade 15, resulting in improved cooling efficiency.

(3) As illustrated in FIG. 10, in the comparative example, part of the cooling air 235 flows from the third cooling passage 223*c* into the communication hole 236, and the flow rate of the cooling air 235 on the cooling downstream side of the first opening 239 in the first wall surface 238 is smaller than that of the cooling upstream side of the first opening 239. As a result, the flow rate of the cooling air 235 flowing on the cooling downstream side of the first opening 239 in the first wall surface 238 is made smaller than that on the cooling upstream side. This would result in the stagnation of the cooling air 235 on the cooling downstream side of the first opening 239 in the first wall surface 238.

By contrast, in the present embodiment, the projection 37 is provided on the cooling downstream side of the first opening 39 of the communication hole 36 such that it protrudes from the first wall surface 38 toward the third cooling passage 23*c*, as illustrated in FIG. 4. Therefore, the cooling air 35 that has flowed close to the first wall surface 38 and has not entered the communication hole 36 can be accelerated at the projection 37. This prevents the flow speed of the cooling air 35 flowing on the cooling downstream side of the projection 37 on the first wall surface 38 from decreasing, which in turn prevents the stagnation of the cooling air 35 on the cooling downstream side of the projection 37 on the first wall surface 38.

Figure 11:
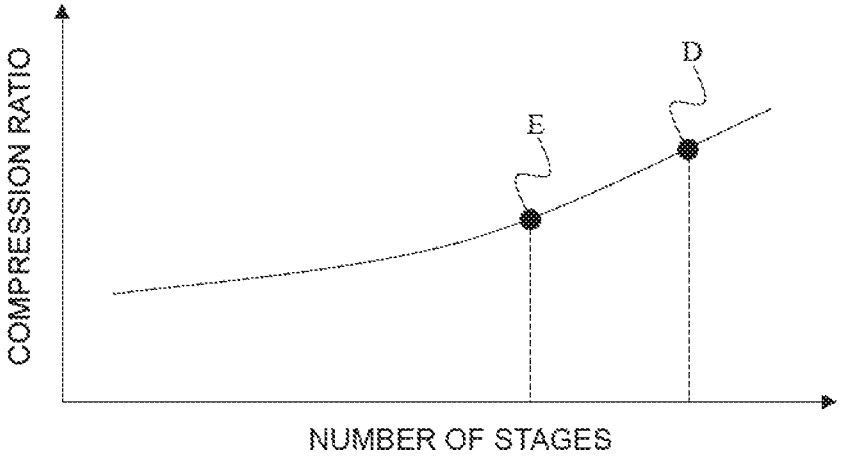
FIG. 11 illustrates improvements in the efficiency of a compressor.

(4) FIG. 11 illustrates improvements in the efficiency of the compressor. The vertical axis represents the compression ratio while the horizontal axis represents the number of stages. In FIG. 11, the point D represents the number of extraction stages (the number of stages used to extract the compressed air) when the projection 37 is not present while the point E represents the number of extraction stages when the projection 37 is present.

The presence of the projection 37 on the cooling downstream side of the first opening 39 of the communication hole 36, which protrudes from the first wall surface 38 toward the third cooling passage 23*c*, prevents the formation of a separation area within the communication hole 36 and reduces the total pressure loss within the communication hole 36. This reduces the pressure difference between the sides of the first opening 39 and the second opening 40 of the communication hole 36. As a result, almost the same amount of the cooling air 35 as when the projection 37 is not present can be made to flow out from the communication hole 36 into the combustion gas passage 17 at a smaller differential pressure. Therefore, in the present embodiment, the compressed air can be extracted from the side where the number of stages of the compressor is small as illustrated in FIG. 11 (the compressed air can be extracted at the point E at which the number of extraction stages is smaller than at the point D), and the efficiency of the compressor can be increased accordingly.

(Others)

The invention is not limited to the embodiment described above but allows various modifications. The above embodiment is intended to be illustrative only, and the invention does not necessarily need to have all the components of the embodiment. For example, some components of the embodiment can be removed or replaced.

In the above embodiment, we have described the structure in which communication holes 36 are formed in the blade section 19 of a rotor blade 15 and projections 37 are provided on the cooling downstream side of the first openings 39 of the communication holes 36. However, the essential object of the invention is to improve the cooling performance of turbine blades, and the invention is not limited to the above structure as long as that essential object can be achieved. For example, it is also possible to form communication holes 36 in the circumferentially inner endwall section 18 of a rotor blade 15 and provide projections 37 on the cooling downstream side of their openings. It is instead possible to form communication holes 36 in the circumferentially inner endwall section 11, blade section 12, and circumferentially outer endwall section 13 of a stator vane 10 and provide projections 37 on the cooling downstream side of their openings. In those cases as well, advantageous effects similar to those of the above embodiment can be obtained.

Also in the above embodiment, we have described the structure in which a communication hole 36 establishes fluid communication between the third cooling passage 23 of the blade section 19 and the combustion gas passage 17. However, the invention is not limited to that structure as long as that essential object can be achieved. For example, it is also possible for the communication hole 36 to establish communication among the first cooling passage 23*a* and the second cooling passage 23*b* of the blade section 19 and the combustion gas passage 17. In that case as well, advantageous effects similar to those of the above embodiment can be obtained.

Further in the above embodiment, we have described the structure in which one communication hole 36 is provided in an extending direction of the blade center line 30 of the blade section 19. However, the invention is not limited to that structure as long as that essential object can be achieved. For example, it is also possible to provide multiple communication holes 36 in an extending direction of the blade center line 30 of the blade section 19. In that case as well, advantageous effects similar to those of the above embodiment can be obtained.

What is claimed is:

1. A turbine blade comprising:

a first wall surface facing a cooling passage through which cooling air flows;

a second wall surface facing a working fluid passage through which a working fluid flows;

a communication hole establishing communication between the cooling passage and the working fluid passage;

a projection provided on a downstream side of the flowing direction of the cooling air in an opening of the communication hole, the opening being formed in the first wall surface, the projection protruding from the first wall surface toward the cooling passage, and a curved section provided adjacent to the projection in a circumferential direction of the opening, the curved section being smoothly connected from the first wall surface to the opening, wherein the projection and the curved section are in contact with the first wall surface on a same plane.

2. The turbine blade of claim 1, wherein the projection includes a slope section formed on the first wall surface, the slope section ascending in a direction opposite the flowing direction of the cooling air toward the cooling passage, and a convex curved section formed on the cooling passage side, the convex curved section being connected to the opening in a form of an arc.

3. The turbine blade of claim 1, wherein the opening is ellipse-shaped.

4. A gas turbine comprising blade stages comprising the turbine blade of claim 1.

* * * * *